US008303353B2

(12) United States Patent
Zhu

(10) Patent No.: US 8,303,353 B2
(45) Date of Patent: Nov. 6, 2012

(54) BATTERY CONNECTOR AND METHOD OF ASSEMBLING THE SAME

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 65 days.

(21) Appl. No.: 13/041,428

(22) Filed: Mar. 6, 2011

(65) Prior Publication Data

US 2011/0312220 A1 Dec. 22, 2011

(30) Foreign Application Priority Data

Jun. 21, 2010 (CN) ..... 2010 1 0204453

(51) Int. Cl.
*H01R 4/48* (2006.01)

(52) U.S. Cl. ..... 439/862

(58) Field of Classification Search ..... 439/65–71
See application file for complete search history.

(56) References Cited

U.S. PATENT DOCUMENTS 7,981,539 B2 * 7/2011 Lai ..... 429/159
8,192,236 B1 * 6/2012 Zhu ..... 439/627
2009/0170374 A1 * 7/2009 Chu et al. ..... 439/627
2009/0298343 A1 * 12/2009 Wu et al. ..... 439/627
2010/0120291 A1 * 5/2010 Hu et al. ..... 439/627

* cited by examiner

*Primary Examiner* — Renee S Luebke
*Assistant Examiner* — Larisa Tsukerman
(74) *Attorney, Agent, or Firm* — Wei Te Chung; Ming Chieh Chang

(57) ABSTRACT

An electrical connector including an insulative housing and a plurality of terminals secured in the housing. The insulative housing defines a mating surface, an assembling surface opposite to the mating surface and a plurality of passageways penetrating through the mating surface and the assembling surface. Each passageway defines two parallel first grooves at each inside wall thereof which run through the assembling surface. A slit are located in front of the first groove and extends perpendicular to and communicates with the first grooves. The terminals are inserted into and received in the passageways from the assembling surface of the insulative housing. Each terminal includes a retention portion with barbs at lateral sides thereof The barbs of the retention portions pass through the first grooves from the assembling surface and are pressed in the slits in a first direction perpendicular to the assembly surface.

8 Claims, 4 Drawing Sheets

BATTERY CONNECTOR AND METHOD OF ASSEMBLING THE SAME

FIELD OF THE INVENTION

The present invention generally relates to an electrical connector, and more particularly to a battery connector and method of assembly contacts thereof

DESCRIPTION OF PRIOR ART

Conventionally, a battery connector comprises an insulative housing and a plurality of terminals received in the insulative housing and a pair of board locks secured at two sides of the housing for mounting the battery connector onto a printed circuit board (PCB). The insulative housing defines a mating surface, a rear surface opposite to the mating surface and a plurality of passageways penetrating through the mating and rear surfaces. The terminals comprises retention portions secured in positioning slits formed in the inner walls of corresponding passageways, resilient portions extending from the retention portions and contacting portions extending beyond the mating surface. However, it is difficult for insertion of terminals accurately into the corresponding positioning slits of the housing. In the meanwhile, the terminals can't be reliably secured in the insulative housing.

Hence, an improved battery connector is highly desired to overcome the aforementioned problems.

SUMMARY OF THE INVENTION

The present invention provides an electrical connector comprising an insulative housing and a plurality of terminals secured in the housing. The insulative housing defines a mating surface, an assembling surface opposite to the mating surface and a plurality of passageways penetrating through the mating surface and the assembling surface. Each passageway defines two parallel first grooves at each inside wall thereof which nm through the assembling surface. A slit is located in front of the first groove and extends perpendicular to and communicates with the first grooves. The terminals are inserted into and received in the passageways from the assembling surface of the insulative housing. Each terminal comprises a retention portion with barbs at lateral sides thereof The barbs of the retention portions pass through the first grooves from the assembling surface and are pressed in the slits in a first direction perpendicular to the assembly surface.

A method of assembling an electrical connector comprises steps of: providing an insulative housing, the insulative housing defining a mating surface, an assembling surface opposite to the mating surface and a plurality of passageways penetrating through the mating surface and the assembling surface, each passageway defining two parallel first grooves at each inside wall thereof which run through the assembling surface and a slit located in front of the first grooves and extending perpendicular to and communicating with the first grooves; providing a plurality of terminals inserted into and received in the passageways from the assembling surface of the insulative housing, each terminal comprising a retention portion with barbs at lateral sides thereof; assembling barbs of the retention portions through the first grooves from the assembling surface and are pressed to shift and retained in the slits in a first direction perpendicular to the assembly surface.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
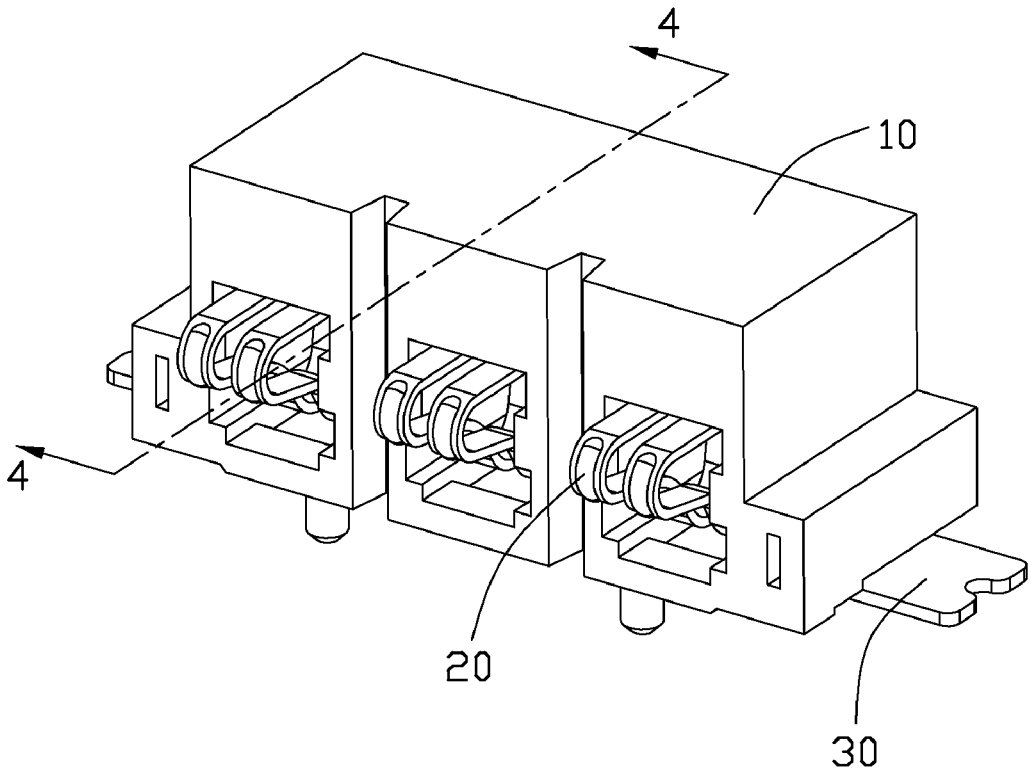
FIG. 1 is an assembled, perspective view of a battery connector of an embodiment of the present invention.
Figure 2:
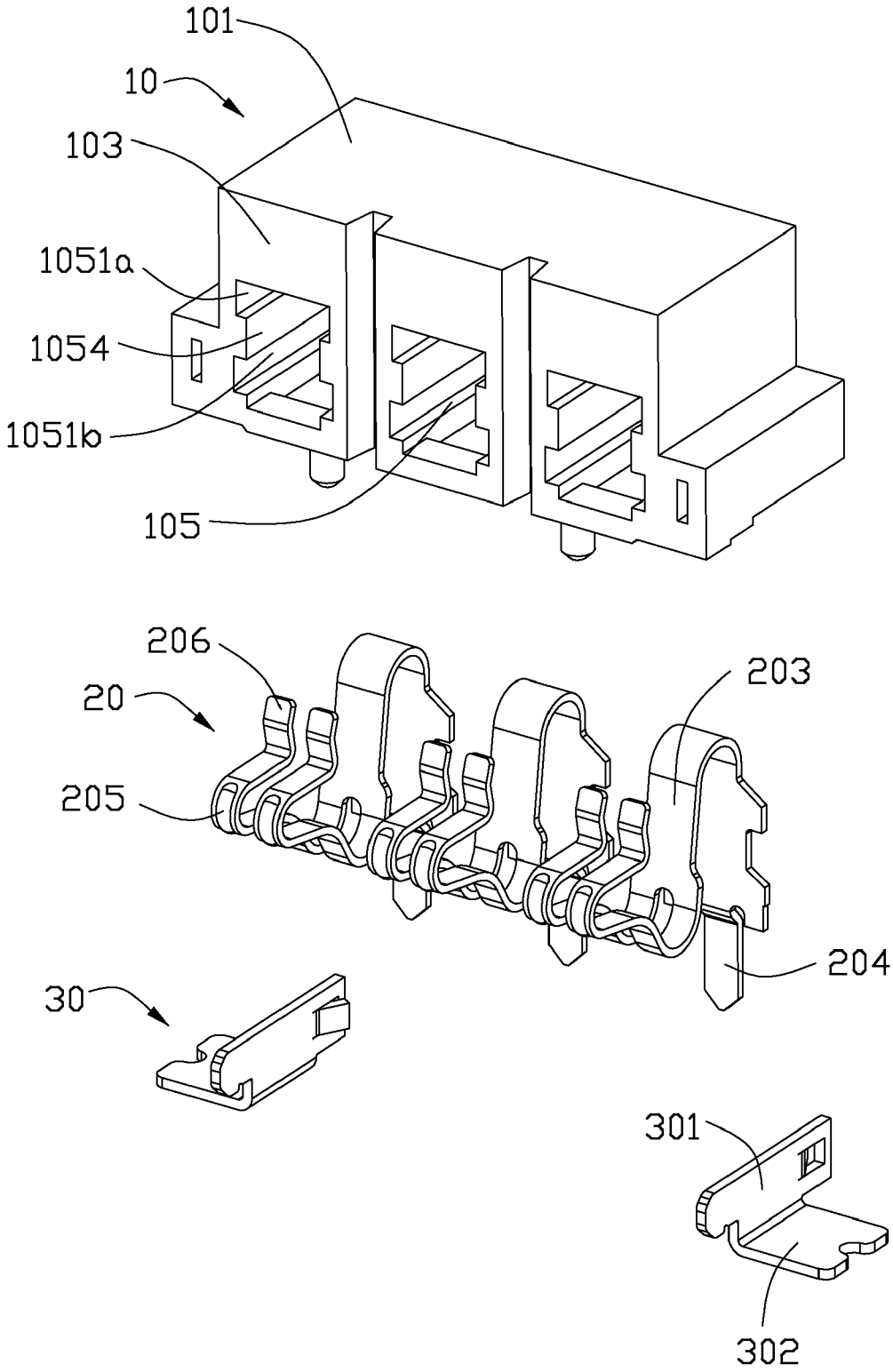
FIG. 2 is an exploded, perspective view of FIG. 1.
Figure 3:
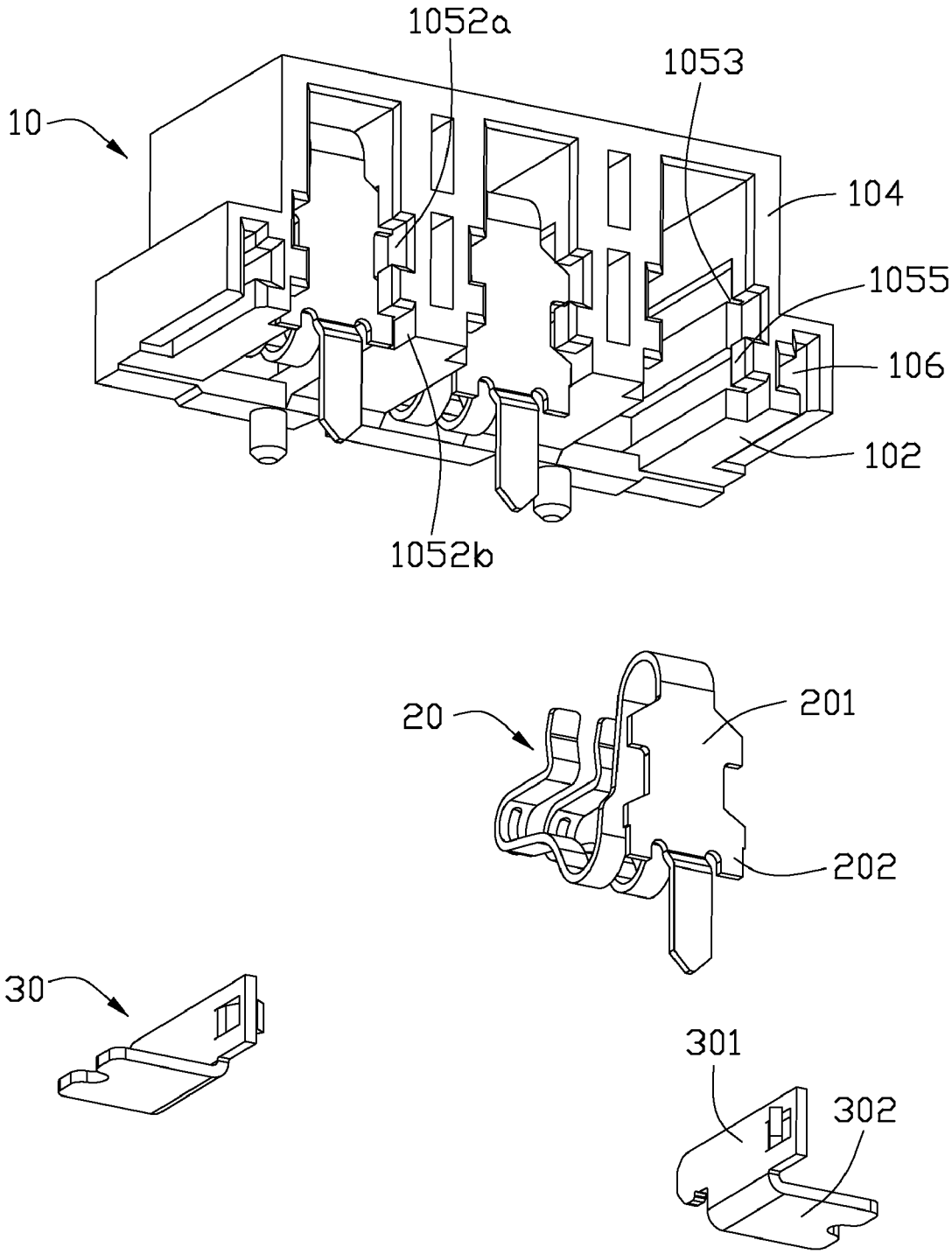
FIG. 3 is another exploded, perspective view of FIG. 2, taken from another aspect.
Figure 4:
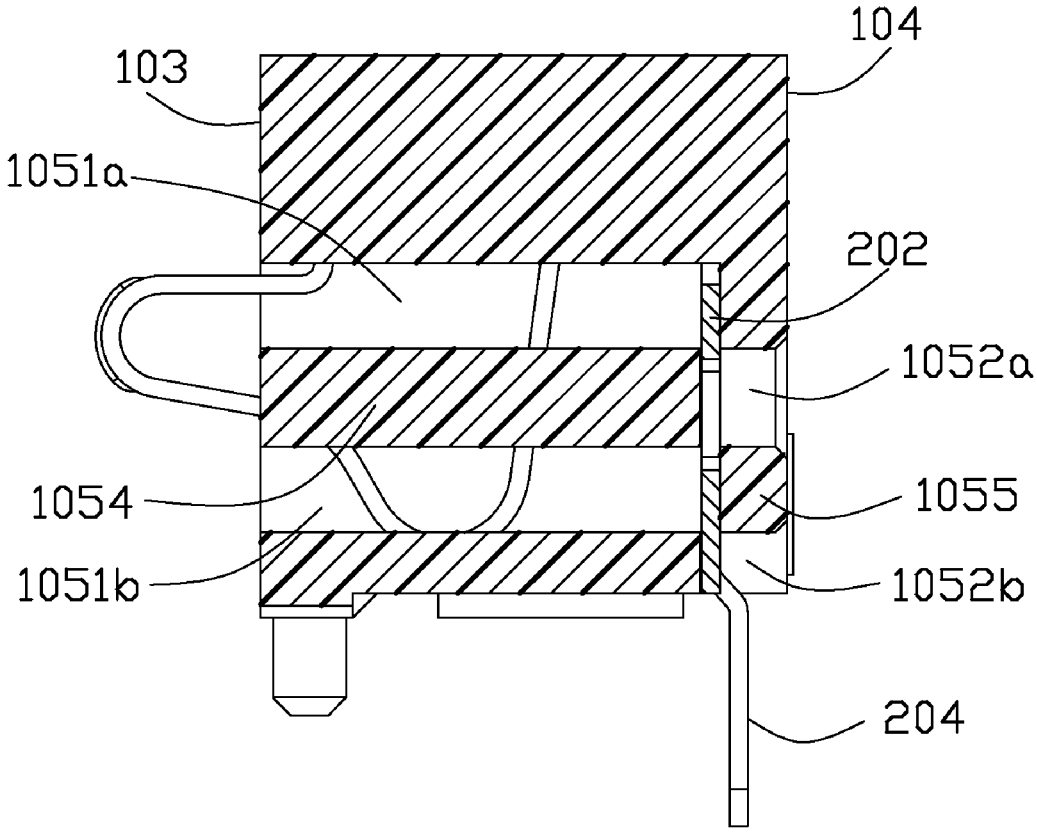
FIG. 4 is a cross-sectional view of the battery connector as shown in FIG. 1, taken along line 4-4.

Referring to FIGS. 1 through 4, a battery connector 1 in accordance with the present invention adapted for being mounted on a printed circuit board (PCB), comprises a longitudinal insulative housing 10, a plurality of terminals 2 retained in the insulative housing 1 and a pair of board locks 30 secured at two sides of the insulative housing 1.

The insulative housing 10 defines an upper surface 101, a lower or mounting surface 102 opposite to the upper surface 101 seated on the PCB (not shown), a rear or assembling surface 104 and a front or mating surface 103 opposite to the rear surface 104. A plurality of passageways 105 penetrate through the mating surface 103, the rear surface 104 along a front-to-back direction. Furthermore the passageways 105 run through some area of the mounting surface 102 adjacent to the rear surface 104. Two pairs of first grooves 1052*a*, 1052*b* are respectively formed in rear portions of opposite inner sidewalls of each passageway 105. The two first grooves 1052*a*, 1052*b* in the same inner sidewall of each passageway 105 are spaced from each other and run through the rear surface 104. Two pairs of second grooves 1051*a*, 1051*b* are respectively formed in front portions of opposite inner sidewalls of each passageway 105. The two second grooves 1051*a*, 1051*b* in the same inner sidewall of each passageway 105 are spaced from each other and run through the mating surface 103. The second grooves 1051*a*, 1051*b* are staggered with the first grooves 1052 along the front-to-back direction and a vertical direction perpendicular to the front-to-back direction. First protrusions 1055 are formed between the corresponding first grooves 1052, and second protrusions 1054 are formed between the second grooves 1051. The first protrusions 1055 are aligned with the corresponding second grooves 1051*b* and have the same width with the second grooves 1051*b* in the vertical direction. The second protrusions 1054 are aligned with the corresponding first grooves 1052*a* and have the same width with the first grooves 1052*a* in the vertical direction. The first protrusion 1055 and the second protrusion 1054 are spaced from each other with a predetermined distance in the front-to-rear direction which is defined as a slit 1053 extending in the vertical direction and communicates with the corresponding first and second grooves 1052*a*, 1052*b*, 1051*a*, 1051*b*. A pair of positioning post extends downwardly and is arranged along the longitudinal direction.

Each terminal 20 comprises a planar retention portion 201, a spring portion 203 extending downwardly from an upper end of the retention portion 201 and a tail portion 204 extending downwardly beyond the mounting surface 102 for being soldered on the PCB. A pair of parallel contacting portions 205 extends from a front end of the spring portion 203 with a pair of tip portion 206 at tip ends of the contacting portions 205. At least one pair of barbs 202 is formed at two lateral sides of the retention portion 201. The contacting portions 205 extend forward beyond the mating surface 103 of the insulative housing 10 so as to mate with a battery (not shown).

Each board lock 30 adapted for being secured in the housing 10 on the PCB comprises a planar latching portion 301 and a planar soldering portion 302 perpendicular to the latching portion 301. The insulative housing 10 has two slots 106 located at two sides thereof. The latching portion 301 of the board lock 30 is received in the slots 106 of the insulative housing 10 and the soldering portion 302 is soldered to the PCB.

In assembly, the terminals 20 are respectively inserted into the corresponding passageways 105 of the insulative housing 10 from the rear surface 104 until the barbs 202 of the retention portions 201 pass through the first passageways 1052*a*, 1052*b* and arrive in the slots wherein the bars are pressed against the second protrusions 1054. Then, the terminals 20 are pushed upwardly in the slots until the barbs partial communicates with the second passageway and sandwich by the first and second projection 1055, 1054 so that the barbs 202 interfere with inside walls of the slits 1053, and in the meanwhile the retention portions 202 are respectively positioned between corresponding first protrusions 1055 and corresponding second protrusions 1054 along the front-to-back direction. Thus, the terminals 20 are reliably positioned in the corresponding passageways 105.

It will be understood that the invention may be embodied in other specific forms without departing from the spirit or central characteristics thereof The present examples and embodiments, therefore, are to be considered in all respects as illustrative and not restrictive, and the invention is not to be limited to the details given herein.

What is claimed is:

1. An electrical connector, comprising:

an insulative housing defining a mating surface, an assembling surface opposite to the mating surface and a plurality of passageways penetrating through the mating surface and the assembling surface, each passageway defining two parallel first grooves at each inside wall thereof which run through the assembling surface and a slit located in front of the first grooves and extending perpendicular to and communicating with the first grooves;

a plurality of terminals inserted into and received in the passageways from the assembling surface of the insulative housing, each terminal comprising a retention portion with barbs at lateral sides thereof;

wherein the barbs of the retention portions pass through the first grooves from the assembling surface and are pressed in the slits in a first direction perpendicular to the assembly surface; wherein each passageway defines two parallel second grooves at inside walls thereof which are located in front of the first grooves and staggered with the first grooves along the first direction.

2. The electrical connector as recited in claim 1, wherein a second protrusion is formed between adjacent second grooves and aligned with the corresponding first groove, a first protrusion is formed between adjacent first grooves and aligned with the corresponding second groove, the barbs are sandwich between the first and second protrusions in the first direction.

3. The electrical connector as recited in claim 2, wherein each terminal comprises a pair of parallel contacting portions extending beyond the mating surface and a pair of tip portions extending from tip ends of the contacting portions.

4. The electrical connector as recited in claim 3, wherein the terminal further comprises a spring portion connecting the retention portion with the contacting portion.

5. A method of assembling an electrical connector, comprising steps of:

providing an insulative housing, the insulative housing defining a mating surface, an assembling surface opposite to the mating surface and a plurality of passageways penetrating through the mating surface and the assembling surface, each passageway defining two parallel first grooves at each inside wall thereof which run through the assembling surface and a slit located in front of the first grooves and extending perpendicular to and communicating with the first grooves and two parallel second grooves which are located in front of the first grooves and staggered with the first grooves;

providing a plurality of terminals inserted into and received in the passageways from the assembling surface of the insulative housing, each terminal comprising a retention portion with barbs at lateral sides thereof;

assembling barbs of the retention portions through the first and second grooves from the assembling surface, and pressing the barbs to shift and be retained in the slits in a first direction perpendicular to the assembly surface.

6. An electrical connector comprising:

an insulative housing defining a plurality of passageways, each of said passageways defining a front opening in a front face, a bottom opening in a bottom face and a rear opening in a rear face for communication with an exterior in a forward direction, a downward direction and a rearward direction, respectively; and a plurality of contacts disposed in the corresponding passageways, respectively, each of said contacts defining a curved front contacting portion, a rear vertical retention portion with barb structures thereon, and a mounting portion extending from the rear vertical retention portion;

each of said passageways being further equipped with a pair of slots communicatively located by two sides thereof and rearwardly extending through the rear face; wherein the contact is allowed to be forwardly inserted into the corresponding passageway through the rear opening with a distance with the barbs structures moving along the corresponding slots, and successively moved upwardly to have the barb structures rearwardly abut against the housing and in a sideward interference with the housing; wherein each of said passageways is further equipped with another pair of slots communicatively located by two sides thereof and forwardly extending through the front face and staggered with said pair of slots in a vertical direction for interference with the barb structures when the contact is upward moved to a final position.

7. The electrical connector as claimed in claim 6, wherein the contacting portion is further equipped with a free tip portion which is essentially hidden behind the front face.

8. The electrical connector as claimed in claim 6, wherein the contacting portion extends forwardly through the front opening beyond the front face and is rearwardly deformable while the retention portion retains the contact in a vertical direction.

* * * * *